US005531635A

United States Patent [19]

Mogi et al.

[11] Patent Number: 5,531,635

[45] Date of Patent: Jul. 2, 1996

[54] TRUING APPARATUS FOR WAFER POLISHING PAD

[75] Inventors: Katsumi Mogi; Osamu Endo, both of Omiya, Japan

[73] Assignee: Mitsubishi Materials Corporation, Tokyo, Japan

[21] Appl. No.: 406,527

[22] Filed: Mar. 20, 1995

[30] Foreign Application Priority Data

Mar. 23, 1994 [JP] Japan ..... 6-052275

[51] Int. Cl.[6] ..... B24B 53/00

[52] U.S. Cl. ..... 451/72; 451/443; 451/56

[58] Field of Search ..... 451/72, 443, 444, 451/56

[56] References Cited

U.S. PATENT DOCUMENTS 5,081,051 1/1992 Mattingly ..... 451/56
5,216,843 6/1993 Breivogel et al. ..... 451/56

FOREIGN PATENT DOCUMENTS 57-149158 9/1982 Japan ..... 451/72
4035870 2/1992 Japan ..... 451/444

*Primary Examiner*—Robert A. Rose
*Attorney, Agent, or Firm*—Armstrong, Westerman, Hattori, McLeland & Naughton

[57] ABSTRACT

A truing apparatus for a wafer polishing pad is provided which is capable of obtaining a sufficient truing effect while keeping the polishing amount of a polishing pad to a maximum. The truing apparatus includes a truing grinding wheel having an abrasive grain layer having ultra-abrasive grains electrodeposited thereon, a support arm for rotatably supporting the truing grinding wheel by bringing the polishing surface of an electrodeposition abrasive grain layer into abutment with the polishing pad, a grinding wheel rotary motor for rotating the grinding wheel, a self-aligning bearing disposed between a grinding wheel support plate and a grinding wheel rotation shaft, and pure water supply means for supplying pure water from the inside of the truing grinding wheel. The outer diameter of the grinding wheel is greater than the outer diameter of the wafers W, and the polishing surface of the grinding wheel is brought into abutment with the polishing pad over the overall width of one circumferential portion of a wafer polishing area. The grain size of the ultra-abrasive grains is preferably set at #60 to #230.

8 Claims, 11 Drawing Sheets

GRAIN SIZE #100/ELECTRO-DEPOSITED CLOTH WAS BONDED (GRINDING WHEEL [C])

GRAIN SIZE #100/ELECTRO-DEPOSITED CLOTH WAS BONDED (GRINDING WHEEL [A])

GRAIN SIZE #100/ELECTRO-DEPOSITED CLOTH WAS BONDED (GRINDING WHEEL [B])

TRUING APPARATUS FOR WAFER POLISHING PAD

BACKGROUND OF THE INVENTION

1. Field of the Invention

The present invention relates to a truing apparatus for truing (shape correcting) a polishing pad used in a wafer polishing apparatus.

2. Description of the Related Art

In general, in a wafer polishing apparatus for polishing the surface of a semiconductor wafer, polishing is performed in such a way that a polishing pad is attached onto the top surface of a disk-shaped platen (fixed plate), one or more wafers are placed on this platen, and a fine diamond slurry is supplied between the polishing pad and the wafers while these wafers are being forcedly rotated on the polishing pad by a carrier. The above-described polishing pad may consist of a velour type pad having a polyurethane resin impregnated into a polyester nonwoven cloth; a suede type pad having a foaming polyurethane layer formed on a polyester nonwoven cloth by using this cloth as a base material; or a polyurethane sheet which is foamed in a closed-cell manner.

It is preferable that the surface of this type of polishing pad be as flat as possible. However, in practice, it cannot be avoided that some irregularities will occur on the surface of the pad due to unevenness of the pad thickness arising from a pad manufacturing step or due to the thickness of a bonding layer required to attach the pad to a platen. Therefore, problems arise, for example, the flatness of the polishing pad exerts an influence upon the flatness of the wafer 1.

Also, there is a drawback in that the surface of the polishing pad becomes toughened, for example, becoming napped or wavy, while wafer polishing is repeated, and thus wafer polishing accuracy is decreased due to the irregularities caused by the roughening.

Therefore, to make the polishing pad flat, a method is disclosed in, for example, Japanese Patent Laid-Open No. 64-71661, in which a correction ring having a diamond pellet stuck on the end surface thereof or having diamond abrasive grains electrodeposited on the end surface thereof is placed on the polishing pad, and the polishing pad and the correction ring are moved relative to each other to polish the surface of the polishing pad, thus increasing the flatness of the surface of the polishing pad. In this case, the desirable grain size of the diamond abrasive grains is assumed to be #400 to #3000.

Also, disclosed in Japanese Patent Laid-Open No. 4-343658 is an apparatus having a wafer mounted on the bottom surface of a top ring and having this wafer pressed against a polishing cloth attached onto the top surface of a turntable and polished, wherein a correction ring is mounted coaxially on the outer circumference on the top ring, the wafer is polished and at the same time the polishing cloth is ground by the correction ring in order to remove the surface roughness.

Disclosed in Japanese Patent Laid-Open No. 4-364730 is an arrangement in which the roughness of a polishing cloth is corrected by making a nylon brush, a pallet having diamonds electrodeposited thereon, or a cutter rotate on the polishing cloth attached to the fixed plate of the wafer polishing apparatus while the nylon brush, the pallet or the cutter is moved forward or backward.

Since the method of truing a polishing pad described in each of the above publications is concerned with grinding the surface of the polishing pad, the thickness of the polishing pad is naturally reduced and may become insufficient after truing is performed a number of times, in which case the polishing pad must be replaced. To replace a polishing pad, a wafer polishing operation must be interrupted, impeding production efficiency. Thus, it is a matter of course that the longer the service life of the polishing pad, the better.

The inventors of the present invention conducted an experiment from the viewpoint of obtaining a sufficient truing effect while keeping the polishing amount of the polishing pad to a minimum. They found that the two means described below make it possible to obtain a high truing effect and to limit the reduction in the amount of the thickness of the polishing pad.

1. A truing grinding wheel is made tiltably movable with respect to its rotational axis so that even when a slight slope is present on the surface of the polishing pad, the polishing surface of the truing grinding wheel is brought into parallel abutment with the polishing pad in such a manner as to follow the slight slope. The inventors of the present invention found that in the conventional construction in which the truing grinding wheel is rigidly fixed with respect to its rotational axis, excessive localized pressure occurs on the abutment surface between the polishing pad and the truing grinding wheel in the truing step, and the polishing pad is ground more than necessary.

2. As abrasive grains which form an abrasive layer of a truing grinding wheel, ultra-abrasive grains of #60 to #230, which are too coarse from the common experience of the person skilled in the art, is used. In the past, it has been thought that use of such ultra-coarse abrasive grains causes the surface of the polishing pad to be roughened. On the contrary, however, the experiment by the inventors of the present invention revealed that this type of coarse abrasive grains does not grind the material of the polishing pad at a predetermined abutment pressure and shows a flattening effect.

SUMMARY OF THE INVENTION

The present invention has been achieved based on the above-described knowledge. It is an object of the present invention to provide a truing apparatus for a wafer polishing pad which is capable of obtaining a sufficient truing effect while minimizing the amount of polishing performed on the polishing pad.

To achieve the above-described object, according to one aspect of the present invention, there is provided a truing apparatus for truing a wafer polishing pad comprising: a truing grinding wheel having an annular abrasive grain layer having ultra-abrasive grains electrodeposited therein in a metallic plating bath; a grinding wheel support mechanism for rotatably supporting the truing grinding wheel in a state in which the polishing surface of the abrasive grain layer is brought into abutment with the surface of the polishing pad; a grinding wheel rotation mechanism for making the truing grinding wheel rotate about its axis; a self-aligning bearing, disposed between the truing grinding wheel and the grinding wheel rotation mechanism, for allowing the tilted movement of the truing grinding wheel; and pure water supply means for supplying pure water from the inside of the truing grinding wheel to between the polishing surface and the polishing pad, wherein the outer diameter of the truing polishing surface is greater than the outer diameter of a wafer to be polished by the polishing pad, and the grinding wheel support mechanism brings the polishing surface of the truing grinding wheel into abutment with the polishing pad over the overall width of one circumferential portion of an annular wafer polishing area on the surface of the polishing pad.

According to another aspect of the present invention, there is provided a truing apparatus for a wafer polishing pad comprising: a truing grinding wheel having an annular abrasive grain layer having ultra-abrasive grains electrodeposited therein in a metallic plating bath; a grinding wheel support mechanism for rotatably supporting the truing grinding wheel in a state in which the polishing surface of the abrasive grain layer is brought into abutment with the surface of the polishing pad; a grinding wheel rotation mechanism for making the truing grinding wheel rotate about its axis; a self-aligning bearing, disposed between the truing grinding wheel and the grinding wheel rotation mechanism, for allowing the tilted movement of the truing grinding wheel; and pure water supply means for supplying pure water from the inside of the truing grinding wheel to between the polishing surface and the polishing pad, wherein the grain size of the ultra-abrasive grains is set at #60 to #230.

In the truing apparatus for a wafer polishing pad in accordance with the first aspect of the present invention, since a self-aligning bearing is disposed between the truing grinding wheel and the grinding wheel rotation mechanism so as to allow the tilted movement of the truing grinding wheel, even when a slight slope is present on the surface of the polishing pad during truing, the polishing surface of the truing grinding wheel is brought into parallel abutment with the polishing pad in such a manner as to follow the slight slope, and the abutment pressure between the polishing pad and the truing grinding wheel is always maintained at less than a fixed value. Therefore, the polishing pad is not ground more than necessary by excessive localized pressure, making it possible to prevent the polishing pad from being consumed. Nevertheless, an excellent flattening effect can be obtained by rubbing the polishing pad with a great number of ultra-abrasive grains projecting from the polishing surface. Since the polishing surface of the truing grinding wheel is brought into abutment with the polishing pad over the overall width of one circumferential portion of a wafer polishing area and pure water is supplied from the inside of the truing grinding wheel to between the polishing surface and the polishing pad, not only is it possible particularly to make the wafer polishing area flat, but it is also possible to supply pure water between the truing grinding wheel and the polishing pad, making it possible to quickly expel foreign matter caused by truing from the wafer polishing area.

In the truing apparatus for a wafer polishing pad in accordance with the second aspect of the present invention, since the grain size of ultra-abrasive grains is set at #60 to #230, it is possible to obtain a satisfactory flattening effect accompanied by minimal grinding of the material of the polishing pad by setting the abutment pressure of the truing grinding wheel in a predetermined range. Further, since a self-aligning bearing is disposed between the truing grinding wheel and the grinding wheel rotation mechanism so as to allow the tilted movement of the truing grinding wheel, even when a slight slope is present on the surface of the polishing pad during truing, the polishing surface of the truing grinding wheel is brought into parallel abutment with the polishing pad in such a manner as to follow the slight slope, and the abutment pressure between the polishing pad and the truing grinding wheel can always be maintained at less than a fixed value. From this respect also, it is possible to prevent the wasteful consumption of the polishing pad.

DESCRIPTION OF THE PREFERRED EMBODIMENTS

Figure 1:
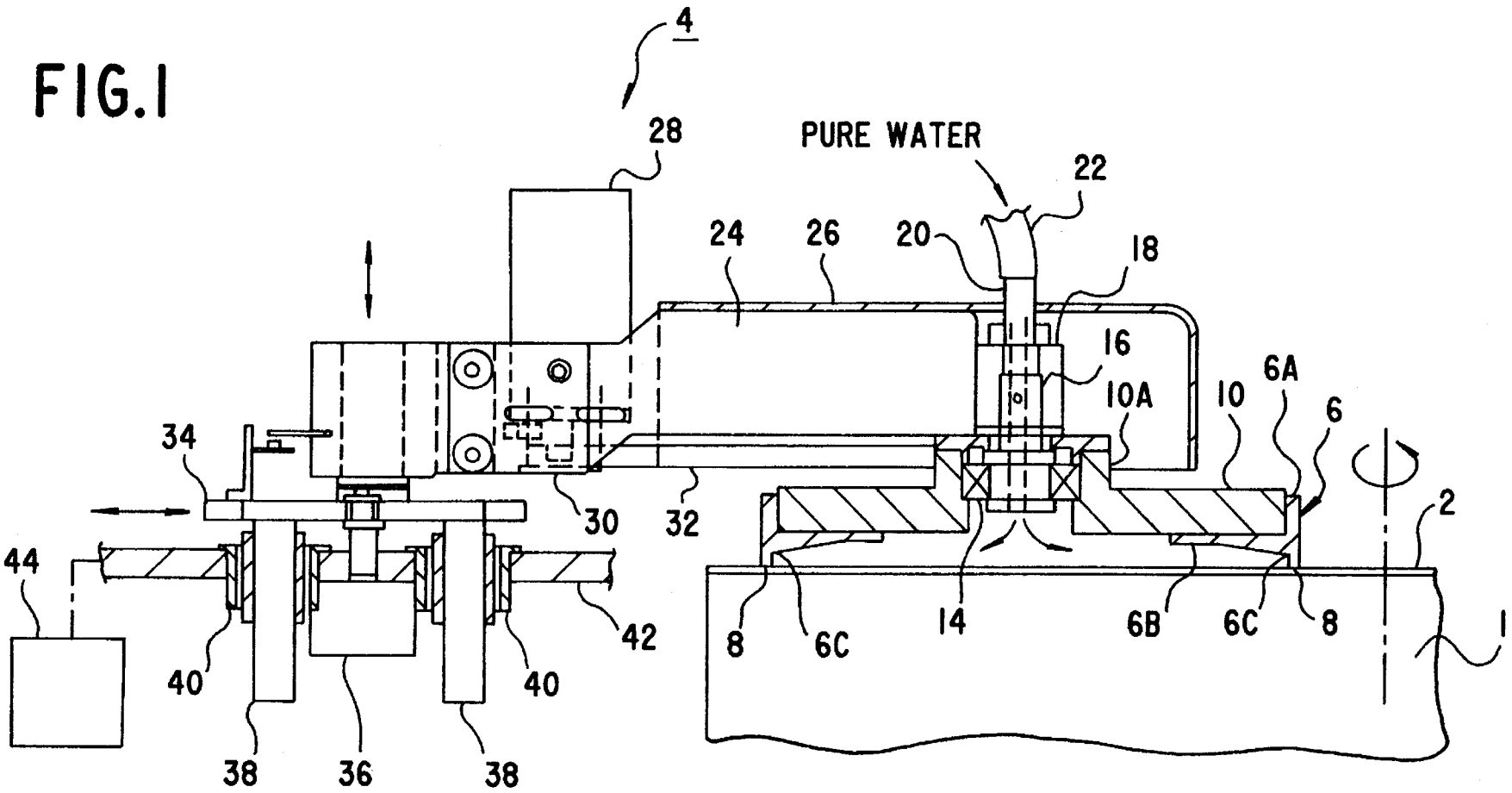
FIG. 1 is a sectional view illustrating a preferred exemplary embodiment of a truing apparatus for a wafer polishing pad in accordance with the present invention.

FIG. 1 is a sectional view illustrating one embodiment of a truing apparatus for a wafer polishing pad in accordance with the present invention. A brief explanation of the construction shown in the figure will be given first.

Figure 2:
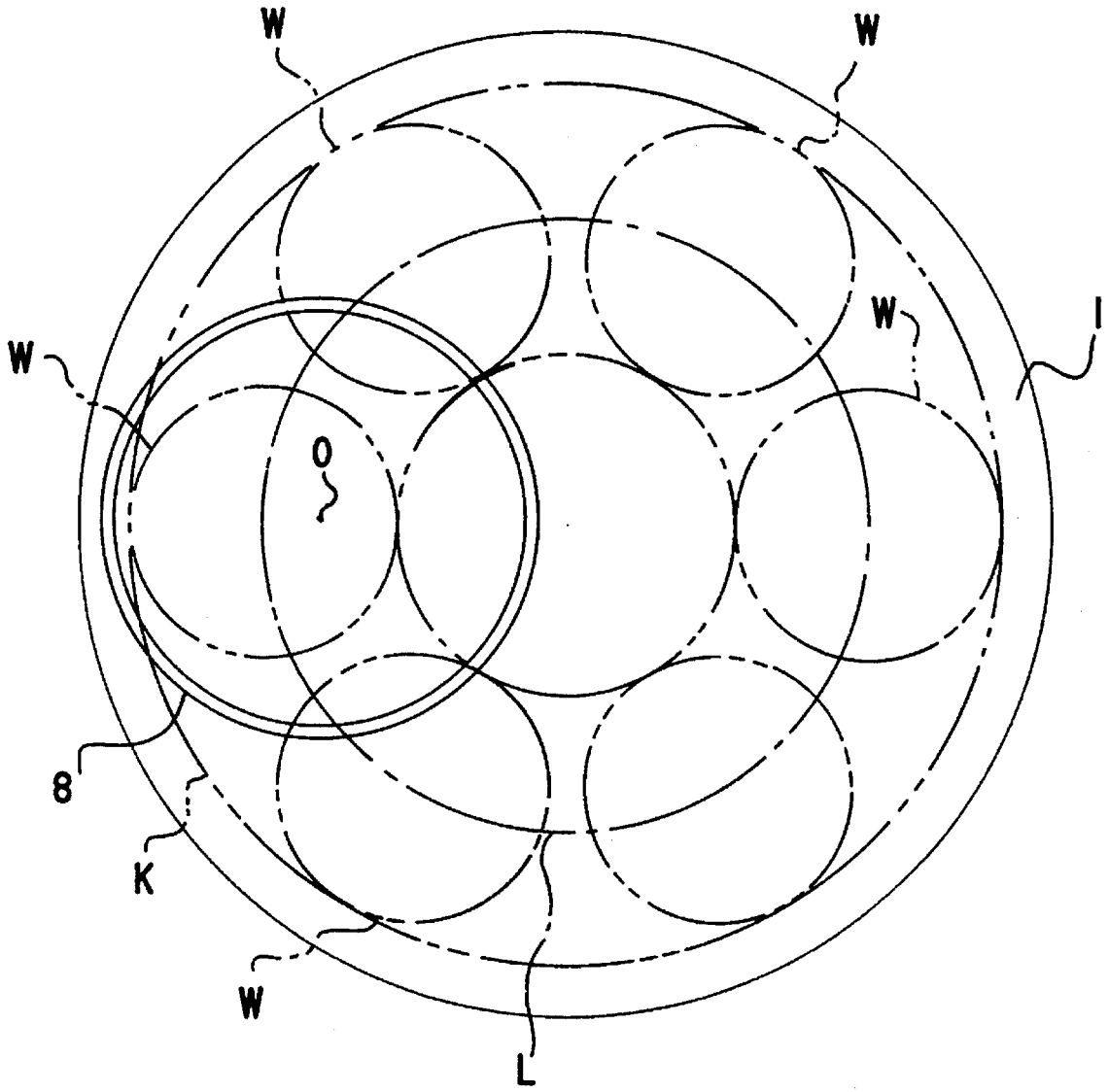
FIG. 2 is a plan view illustrating the positional relationship between a platen and an electrodeposition abrasive grain layer in accordance with the preferred exemplary embodiment of the present invention.

Referring to FIG. 1, reference numeral 1 denotes a platen (lower fixed plate) of a wafer polishing apparatus. The platen 1 is formed in a circular plate shape, as shown in FIG. 2, and is rotated horizontally about its axis by a drive means (not shown). A circular polishing pad 2 is attached on the entire top surface of the platen 1. In this example, as shown in FIG. 2, a plurality (six in the figure) of wafers W are placed on the platen 1, and the wafers W are planetarily rotated by a carrier (not shown) while the relative positions of the wafers W are maintained and are polished.

Any conventional materials which are used to polish wafers may be used for the polishing pad 2. A velour type pad having a polyurethane resin impregnated into a nonwoven cloth made of polyester, a suede type pad having a foaming polyurethane layer formed on a polyester nonwoven cloth by using this cloth as a base material, or a polyurethane sheet which is formed in a closed-cell manner may be used.

Reference numeral 4 denotes a truing apparatus which has a truing grinding wheel 6 in the shape of a circular disk placed on the polishing pad 2. The grinding wheel 6 is formed of an annular peripheral wall portion 6A having a fixed height, a bottom wall portion 6B which horizontally extends from the peripheral wall portion 6A to the inside, and an annular abrasive grain layer formation portion 6C formed in the lower end of the peripheral wall portion 6A, an electrodeposition abrasive grain layer 8 being formed on the entire surface of the bottom surface of the abrasive grain layer formation portion 6C.

The outer diameter (equal to the outer diameter of the electrodeposition abrasive grain layer 8 in this embodiment) of the polishing surface of the truing grinding wheel 6 is greater than the outer diameter of the wafers W to be polished by the polishing pad 2, as shown in FIG. 2. The truing grinding wheel is brought into abutment with the polishing pad 2 over the overall width of one circumferential portion of the annular wafer polishing area K on the surface of the polishing pad. As a result, it is possible to perform truing uniformly over the entire surface of the wafer polishing area K.

The grain size of the ultra-abrasive grains used in the electrodeposition abrasive grain layer 8 is from #60 to #230 and, more preferably, from #80 to #170. If the grain size is greater than #60, the effect of making the surface of the polishing pad 2 flat is decreased, causing the polishing accuracy of the wafers W to be decreased. If the grain size is smaller than #230, the effect of grinding the surface of the polishing pad 2 is increased, causing the thickness of the polishing pad 2 to decrease, and the service life thereof is shortened. That is, only when the grain size of the ultra-abrasive grains is from #60 to #230 is it possible to obtain a satisfactory flatting effect without hardly grinding the polishing pad 2 by setting the abutment pressure of the truing grinding wheel 6 in a predetermined range determined by the material or the like of the polishing pad 2.

A grinding wheel support plate 10 is a circular plate shape is coaxially inserted inside the peripheral wall portion 6A of the truing grinding wheel 6 and fixed. The grinding wheel support plate 10 is supported by a grinding wheel rotation shaft 16 via a self-aligning bearing 14, and the grinding wheel rotation shaft 16 is fixed to the front end of a support arm 24.

The grinding wheel rotation shaft 16 takes the form of a hollow tube. A pure water supply pipe 22 is connected to the top end of the grinding wheel rotation shaft 16 via a pure water supply pipe 20 and connected to a pure water supply source (not shown). In this embodiment, since an opening is formed in the central portion of the bottom wall portion 6B, when pure water is supplied from the pure water supply means, the pure water will flow into the interior of the truing grinding wheel 6. The pure water flows outside successively through the section between the electrodeposition abrasive grain layer 8 and the polishing pad 2, and foreign matter is expelled in that process.

A cover 26 for covering the top surface of the grinding wheel support plate 10 is fixed to the front end of the support arm 24. A grinding wheel rotary motor 28 is fixed so as to face downward on the base end of the support arm 24, and a pulley 30 is fixed to the lower end of the shaft of the motor. A drive belt 32 is wound between the pulley 30 and a pulley portion 10A of the grinding wheel support plate 10, and a rotational force is transmitted.

The base end of the support arm 24 is fixed to a horizontal arm support plate 34 which is fixed to the end of the rod of an arm up-and-down cylinder 36 fixed upward with respect to a mobile table 42. A pair of guide rods 38 are fixed to the arm support plate 34 and supported so as to move vertically by a guide boss 40 which is passed through the mobile table 42. The mobile table 42 is designed to move horizontally by an arm advance/retreat mechanism 44 between the position at which the truing grinding wheel 6 faces the platen 1 and the position at which the truing grinding wheel 6 retracts from the platen 1.

The grinding wheel rotary motor 28, the arm up-and-down cylinder 36, and the arm advance/retreat mechanism 44 each are controlled by programs from an operation panel (not shown). Further, the truing grinding wheel 6 is designed to be brought into abutment with the polishing pad 2 at 0.1 to 1 kgf/cm$^2$ and, more preferably, at 0.2 to 0.6 kgf/cm$^2$. If the pressure is less than 0.1 kgf/cm$^2$, it is difficult to obtain a satisfactory flattening effect, and if the pressure is greater than 1 kgf/cm$^2$, the truing grinding wheel 6 will grind the polishing pad 2, thereby reducing the service life of the polishing pad 2.

In the above-described pressure range, it is preferable that truing is programmed to be performed continuously for 0.5 to 5 minutes in one truing step. If truing is performed for less than 0.5 minutes, it is difficult to obtain a satisfactory flatting effect, and if performed for more than 5 minutes, there is no appreciable change in the flattening effect, but the truing grinding wheel 6 may grind the polishing pad 2, shortening the service life of the polishing pad 2.

According to the truing apparatus 4 constructed as described above, the grain size of ultra-abrasive grains is set at #60 to #230, the abutment pressure of the truing grinding wheel 6 is set in the above-described range. Thus, even if the material of the polishing pad 2 is hardly ground, the surface of the polishing pad 2 is made smooth by rubbing the polishing pad 2 by a large number of abrasive grains projecting from the polishing surface of the truing grinding wheel 6, and thus an excellent flattening effect can be obtained. Further, since a great number of fine streaks having just the right degree of depth and width are caused on the surface of the polishing pad 2 by ultra-abrasive grains in the above-described grain size range, a slurry is circulated through these streaks and spread over the entire trued surface of the polishing pad 2 during wafer polishing. Therefore, the density of free abrasive grains can be made uniform during wafer polishing, and also the entire polishing surface of the wafers W can be uniformly cooled. Thus, it is possible to prevent a deviation of the polishing amount due to local thermal expansion.

Also, since the self-aligning bearing 14 is disposed between the grinding wheel support plate 10 and the grinding wheel rotation shaft 16 so as to allow the tilted movement of the truing grinding wheel 6 in the truing step, even when a slight slope is present on the surface of the polishing pad 2 during truing, the polishing surface of the truing grinding wheel 6 is brought into parallel abutment with the polishing pad 2 in such a manner as to follow the slight slope, and the abutment pressure between the polishing pad 2 and the truing grinding wheel 6 can always be maintained at less than a fixed value. Therefore, the polishing pad 2 will not be ground more than necessary by excessive localized pressure, making it possible to prevent the polishing pad 2 from being consumed.

Since the polishing surface of the truing grinding wheel 6 is brought into abutment with the polishing pad over the overall width of one circumferential portion of the wafer polishing area K and pure water is supplied from the inside of the truing grinding wheel 6, not only is it possible to make the wafer polishing area K flat, but it is also possible to supply pure water between the truing grinding wheel 6 and the polishing pad 2, making it possible to quickly expel foreign matter or the like caused by truing from the wafer polishing area K.

Of course, the present invention is not limited to the above-described embodiment, and various modifications may be made as required. For example, although in the above-described embodiment ultra-abrasive grains are directly electrodeposited on the surface of the abrasive grain layer formation portion 6C, instead, an ultra-abrasive grain electrodeposited cloth having ultra-abrasive grain electrodeposited on a soft cloth may be bonded to the abrasive grain layer formation portion 6C by a bonding agent in order to form the abrasive grain layer 8. In that case, the cloth and the bonding agent layer exhibit a cushion effect, and excessive pressure is prevented from being applied to each individual ultra-abrasive grain. Therefore, it is possible to further reduce the amount of consumption of the polishing pad 2. In this case, the preferable grain size of ultra-abrasive grains and the preferable abutment pressure are the same as those described above.

EXPERIMENTAL EXAMPLES

Figure 3:
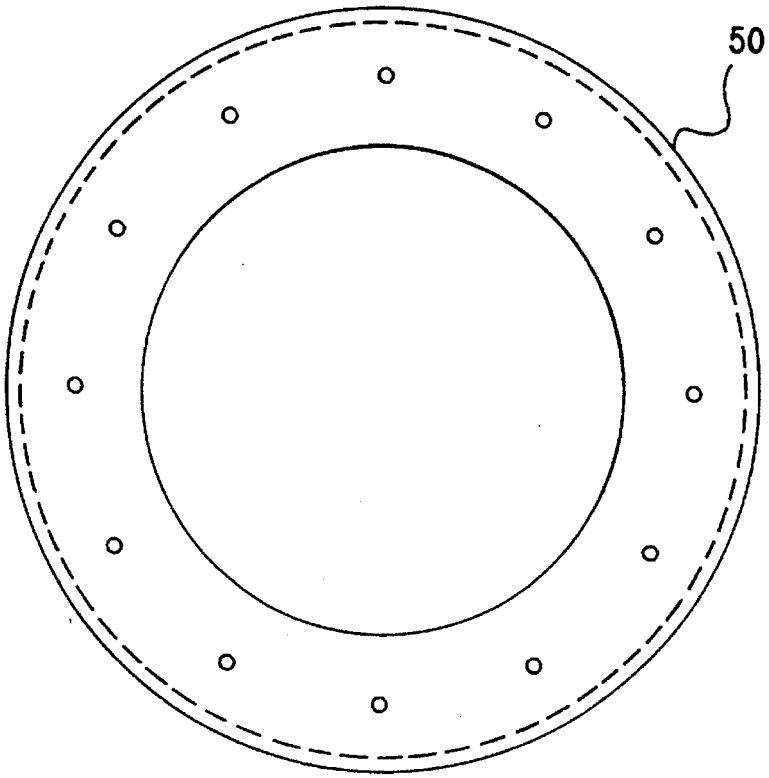
FIG. 3 is a plan view of a truing grinding wheel used in an experiment in accordance with the present invention.
Figure 4:
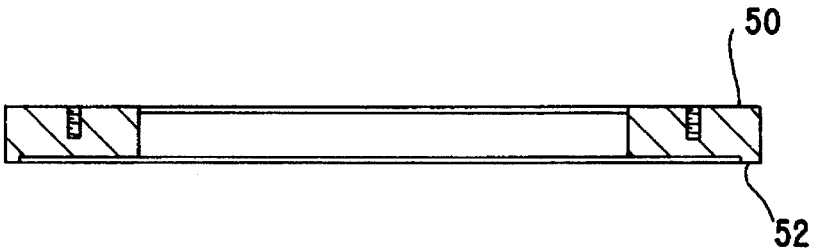
FIG. 4 is a sectional view of a truing grinding wheel.
Figure 5:
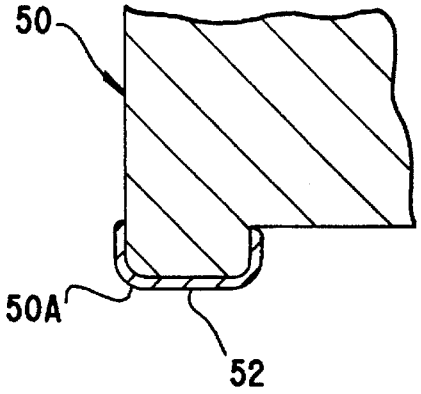
FIG. 5 is an enlarged sectional view of the electrodeposition abrasive grain layer of the truing grinding wheel.

The apparatus shown in FIG. 1 was actually produced, and truing experiments for a polishing pad were carried out. However, in place of the truing grinding wheel 6, a truing grinding wheel 50 shown in FIGS. 3 to 5 was directly fixed to the grinding wheel support plate 10.

The truing grinding wheel 50 was used such that an abrasive grain layer formation portion 50A which projects downward is formed in the outer circumferential portion of an annular base metal of the truing grinding wheel 50, and an electrodeposition abrasive grain layer 52 is formed on the bottom surface of the abrasive grain layer formation portion. The dimensions of the truing grinding wheel 50 are as follows: outer diameter is 305 mm, inner diameter is 200 mm, and the width of the electrodeposition abrasive grain layer 52 is 5 mm. Two types of grinding wheels (grinding wheels (a) and (b)) having the same base metal and having ultra-abrasive grains of #100 or #400 electrodeposited thereon were prepared. As another truing grinding wheel (c), a truing grinding wheel was prepared which does not have the abrasive grain layer formation portion 50A formed on the base metal and in which an ultra-abrasive grain electrodeposition cloth having ultra-abrasive grains electrodeposited on a cloth made of polyester is bonded onto the entire surface of the bottom surface of the base metal by using an epoxy resin.

Figure 6:
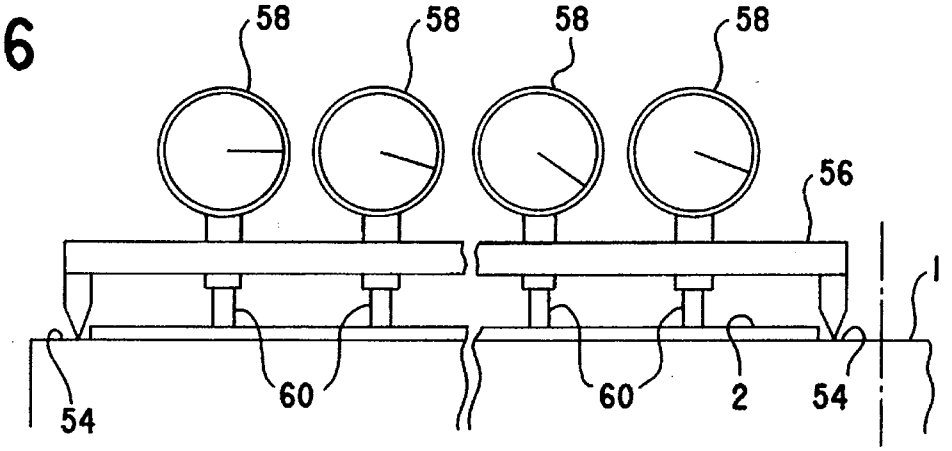
FIG. 6 is a front view illustrating a method of measuring the thickness of the polishing pad used in the experiment.

The thickness of the polishing pad 2 was measured by using a measurement device shown in FIG. 6. This measurement device has a support rod 56 having legs on both ends thereof and a total of six dial gauges 58 fixed to the support rod 56. After each dial gauge 58 is zero adjusted beforehand on the surface of a reference flat member (master flat), the dial gauge 58 is brought into abutment with the polishing pad 2 on the platen 1, and the thickness of the polishing pad 2 was measured. The outer circumferential portion and the central portion of the polishing pad 2 were cut out beforehand so as to expose the surface of the platen 1, and the legs of the support rod 56 were placed on the central portion and the circumferential portion of the polishing pad 2.

Figure 7:
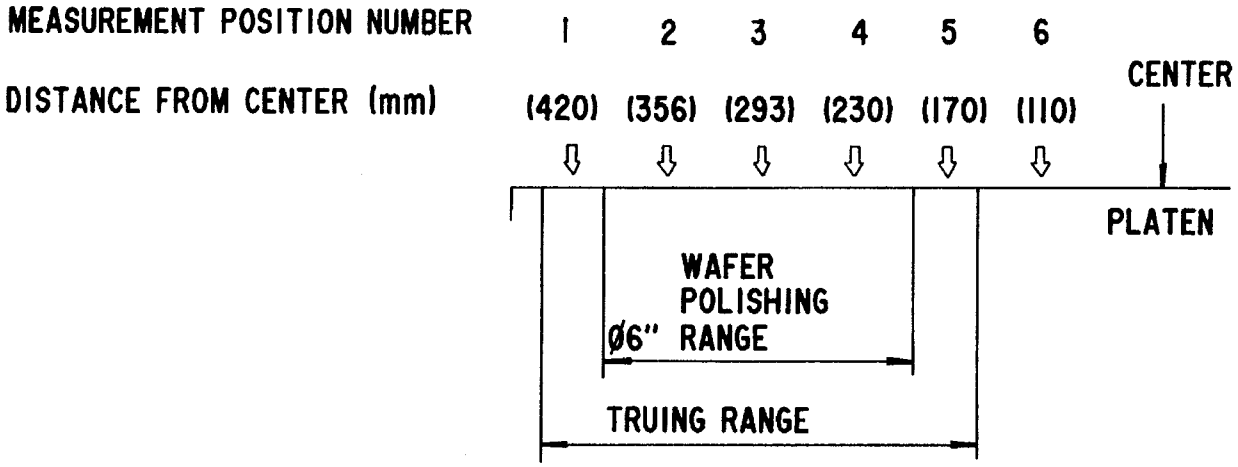
FIG. 7 is an illustration of the position at which the thickness of the polishing pad used in the experiment is measured.

The platen 1 was 915 mm in diameter, and the polishing pad 2 used was made of foaming polyurethane, 1–3 mm thick (Shore hardness: 61). A method was employed in which six of 6-inch silicon wafers were polished while the wafers were planetarily rotated at a time on the platen 1. A thermal oxide silica film was pre-formed on the polishing surface of the wafer. The positions of measurements by the dial gauges 58 were at the following distances from the center of the platen: 110, 170, 230, 293, 356 and 420 mm (referred to as measurement points 5, 5, 4, 3, 2 and 1 in this order), as shown in FIG. 7. The outer diameter of the wafer to be polished was 6 inches (150 mm), and the center of the platen comes to the position 293 mm from the center of the platen. The center of the truing grinding wheel 50 was also set at a position of 293 mm from the center of the platen. That is, the range of truing by the truing grinding wheel 50 extends by 77 mm toward the inner circumferential portion and the outer circumferential portion of the wafer polishing area, respectively.

The test was conducted as follows:

1. A new polishing pad 2 was bonded to the platen 1, and the initial thickness of the polishing pad 2 was measured.

2. Initial truing was performed in such a way that the truing grinding wheel 50 was brought into abutment with the polishing pad 2 at a fixed pressure, the truing grinding wheel 50 was rotated at 25 rpm while pure water was being supplied to the inside of the truing grinding wheel 50, and at the same time the platen 1 was rotated for a predetermined time at 25 rpm. At this point, the thickness of the polishing pad 2 after the initial truing was measured again.

3. Wafer polishing was performed under fixed conditions, and the thickness of the polishing pad after wafer polishing was measured.

4. Truing was performed under the same conditions as in the initial truing, after which the thickness of the polishing pad 2 was measured.

5. The above steps 3 and 4 were repeated.

The truing conditions were: the abutment pressure of the truing grinding wheel for grinding wheel (c) was 0.16 $kgf/cm^2$, 0.53 $kgf/cm^2$ for the grinding wheels (a) and (b). The truing time was five minutes for each grinding wheel. The wafer polishing conditions were: wafer abutment pressure was 0.5 $kgf/cm^2$, and polishing time was 3.5 minutes for each grinding wheel.

Figure 8:
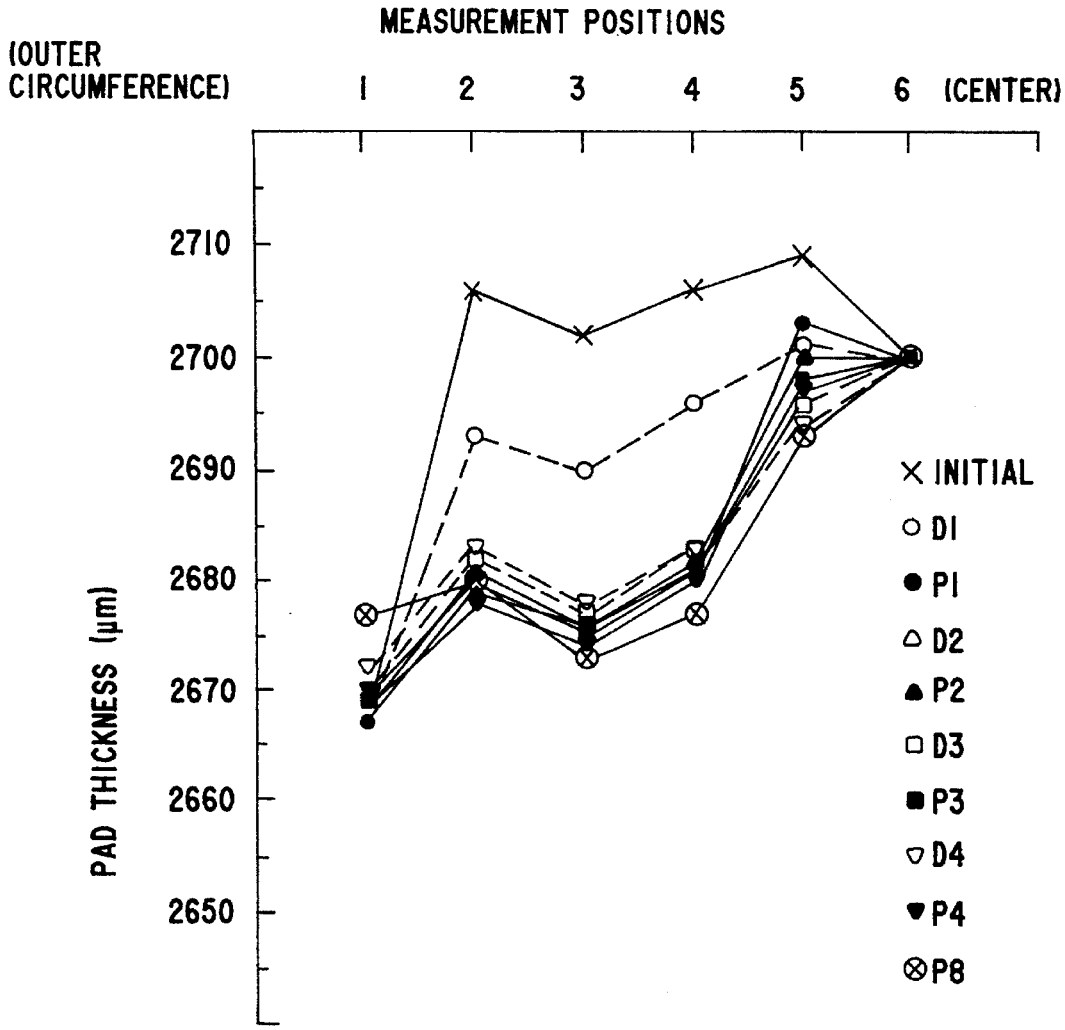
FIG. 8 is a graph illustrating the result of the experiment in truing wheel (c) of grain size of #100.
Figure 9:
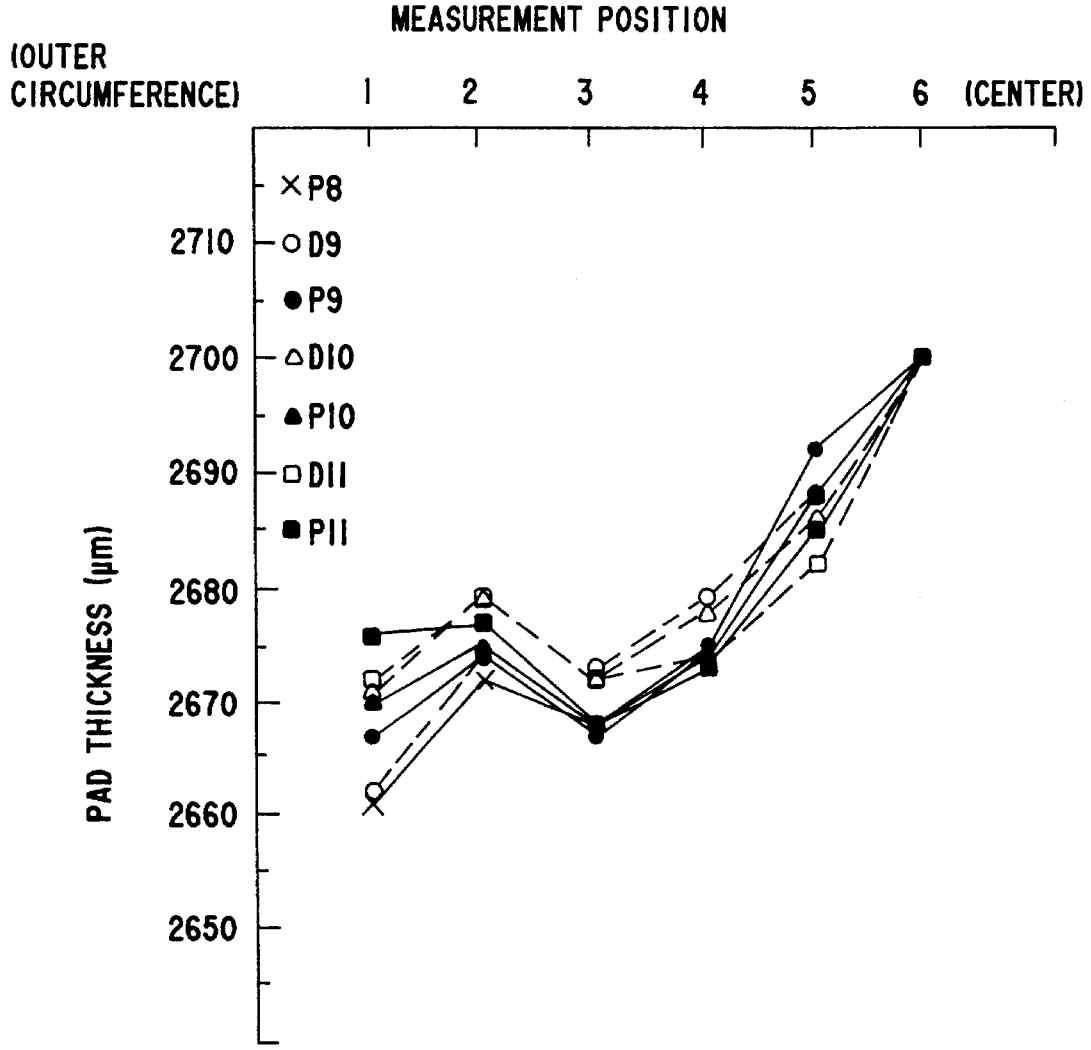
FIG. 9 is a graph illustrating the result of the experiment in truing wheel (a) of grain size of #100.
Figure 10:
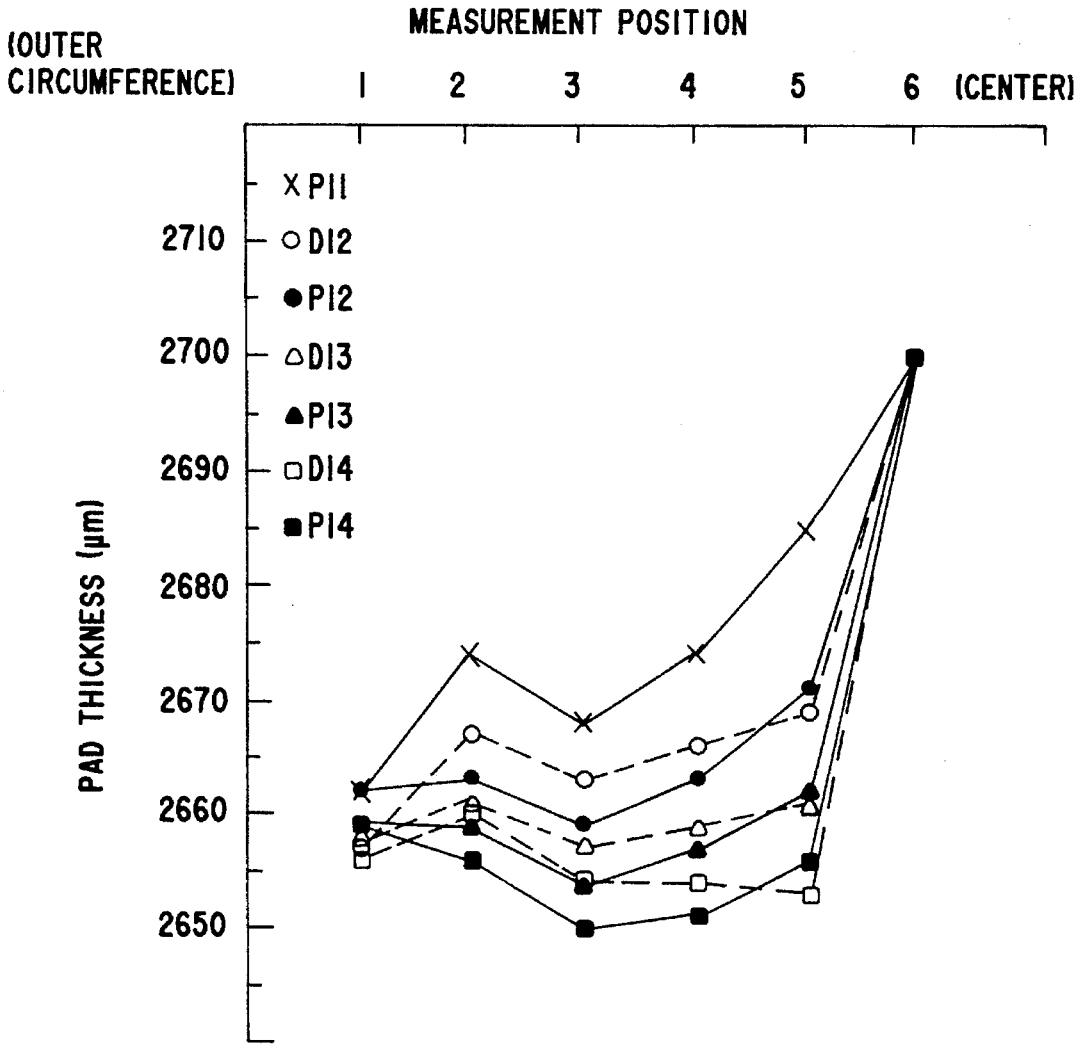
FIG. 10 is a graph illustrating the result of the experiment in truing wheel (b) of grain size of #100.

First to eighth truings were performed by truing wheel (c) for the same polishing pad 2. Ninth to eleventh truings were performed by truing wheel (a), and twelfth to fourteenth truings were performed by truing wheel (b). The results of the truings are shown in FIGS. 8 to 10. In these figures Dn indicates a measured value immediately after n-th truing was performed; Pn indicates a measured value immediately after n-th wafer polishing was performed, and correction was made so that the measured values of measurement point 6 on the center side match each other. The reason for this correction is that the measurement point 6 does not abut the truing grinding wheel or the wafer, and the thickness thereof does not change.

As shown in FIG. 8, in the grinding wheel (c) having an ultra-abrasive grain electrodeposition cloth electrodeposited with ultra-abrasive grains of grain size #100 bonded thereto, the thickness of the polishing pad 2 hardly changed after the second truing. Also, as shown in FIG. 9, in the grinding wheel (a) which was directly electrodeposited with ultra-abrasive grains of grain size #100, the thickness of the polishing pad 2 hardly changed after the second truing. In contrast, in the grinding wheel (b) which was directly electrodeposited with ultra-abrasive grains of grain size #400, it was confirmed that the thickness of the polishing pad 2 decreased each time truing and wafer polishing were performed.

Next, changes in the wafer polishing speed by the polishing pad trued by grinding wheels (a) to (c) and the evenness of the thickness of the wafer were measured. To be specific, truing and wafer polishing using truing wheel (b) were alternately repeated three times for the polishing pad which was the same as that described above, after which truing and wafer polishing using truing wheel (a) were repeated alternately three times, further after which truing and wafer polishing using truing wheel (c) were performed twice. The truing conditions for each truing wheel were as follows: the abutment pressure of the truing wheel was 0.16 $kgf/cm^2$ for the truing wheel (c), and 0.53 $kgf/cm^2$ for truing wheels (a) and (b), and the truing time was five minutes for each truing wheel. The wafer polishing conditions were: wafer abutment pressure was 0.5 $kgf/cm^2$, and polishing time was 3.5 minutes for each truing wheel.

Figure 11:
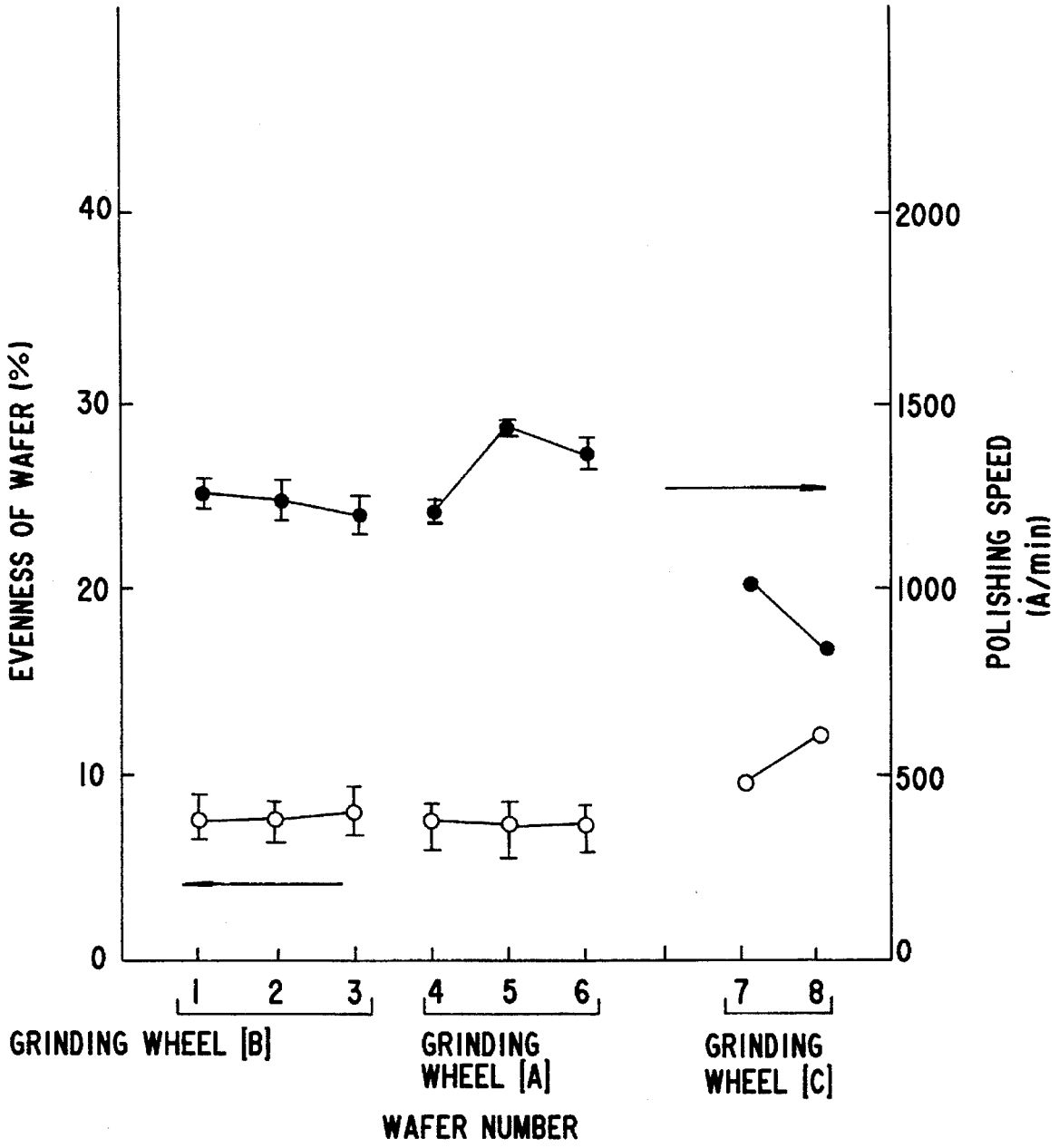
FIG. 11 is a graph illustrating the results of the experiment in truing wheels (a) to (c)

The results of the experiment are shown in FIG. 11. In this experiment, in truing wheel (b) in which ultra-abrasive grains of #400 are used, a tendency was seen that the wafer polishing speed decreased slightly each time truing was performed, whereas in truing wheel (a) in which ultra-abrasive grains of #100 were used, the wafer polishing speed increased, and thus the truing wheel (a) proved to have an excellent dressing effect. However, in practice, the change in the wafer polishing speed is undesirable. Therefore, by shortening the truing time to one minute and performing the same test, it was confirmed that the wafer polishing speed become nearly constant also in truing wheel (a). On the other hand, in truing wheel (c), since the truing wheel abutment pressure was too small, a sufficient dressing effect could not be shown.

As regards the evenness of the wafer thickness, nearly the same results were obtained for truing wheels (a) and (b). However, the evenness of truing wheel (c) was lower than the other truing wheels because of the insufficient truing wheel abutment pressure. Since the result of truing wheel (c) is through to be caused by the insufficient truing wheel abutment pressure, if the area of the abrasive grain layer is decreased and the truing wheel abutment pressure is increased to the same extent as that of truing wheel (a), the same degree of evenness as a case in which ultra-abrasive grains were directly electrodeposited can be obtained even when an ultra-abrasive grain electrodeposition cloth is used.

Figure 12:
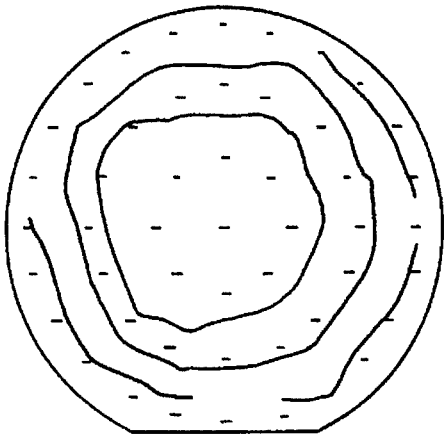
FIG. 12 is a contour line diagram illustrating the evenness of the wafer in truing wheel (c) of grain size of #100.
Figure 13:
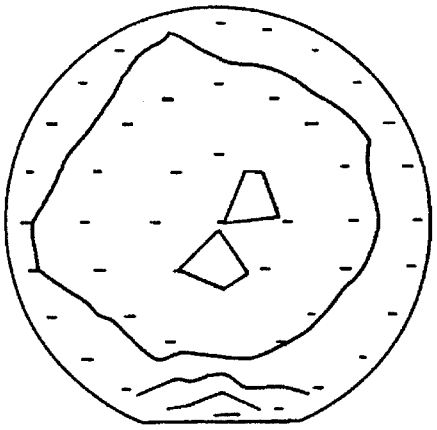
FIG. 13 is a contour line diagram illustrating the evenness of the wafer in truing wheel (a) of grain size of #100.
Figure 14:
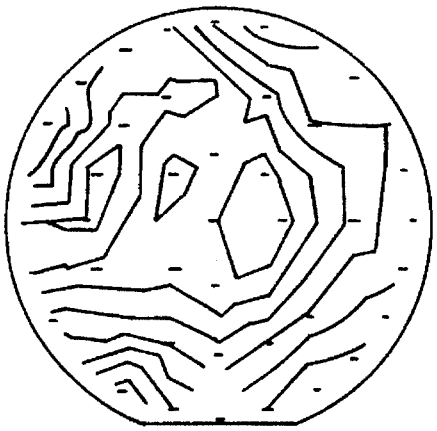
FIG. 14 is a contour line diagram illustrating the evenness of the wafer in truing wheel (b) of grain size of #100.

FIGS. 12 to 14 show the evenness of the surface of the wafer polished by the polishing pad 2 which was trued by each truing grinding wheel. FIG. 12 shows the result in truing wheel (c); FIG. 13 shows the result in truing wheel (a); and FIG. 14 shows the result in truing wheel (b). The interval of the contour lines is 0.01 μm. As can be seen in these figures, in the case of truing wheels (c) and (a) in which ultra-abrasive grains of #100 were used, the evenness of the wafer was increased more than that of truing wheel (b). It is assumed that this increase is attributed to the fact that the polishing slurry was supplied uniformly, the polishing temperature was made uniform, and the expelling property of polishing chips was improved.

Next, the truing time was changed to three and five minutes when truing was performed by using truing wheel (a), and the wafer polishing speed and the evenness of the wafer thickness were measured for each of sixth wafers which are polished at a time. The other truing and wafer polishing conditions were the same as in the previous experiment.

Figure 15:
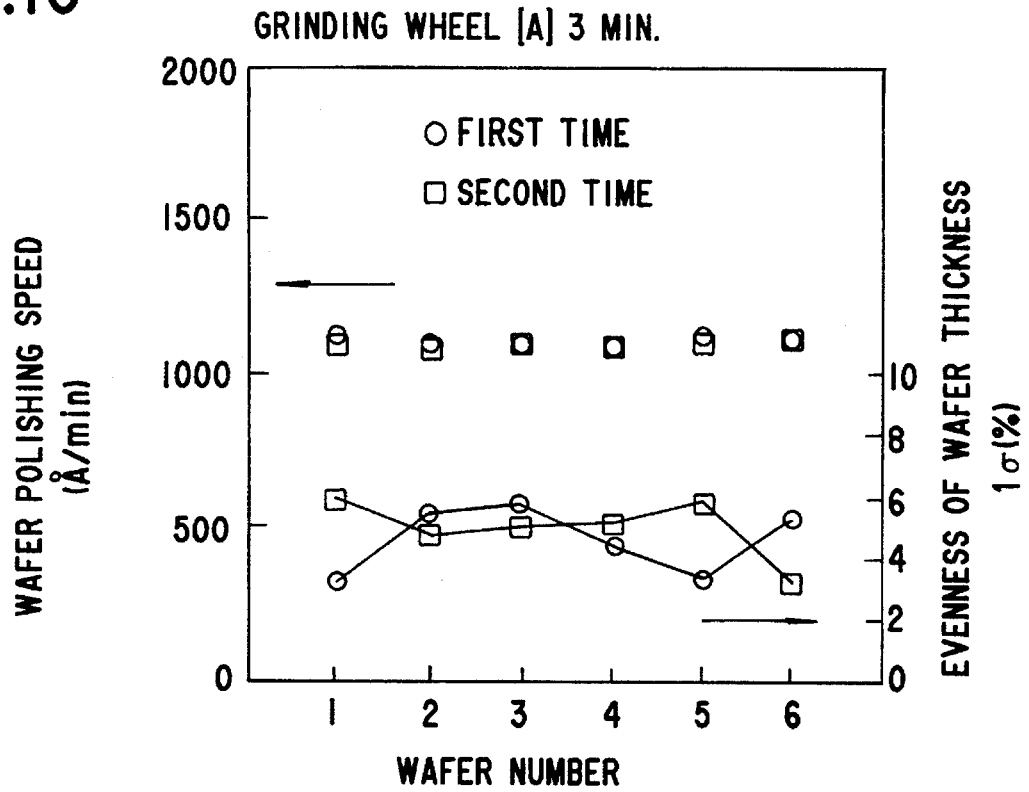
FIG. 15 is a graph when the truing time is three minutes in truing wheel (a)
Figure 16:
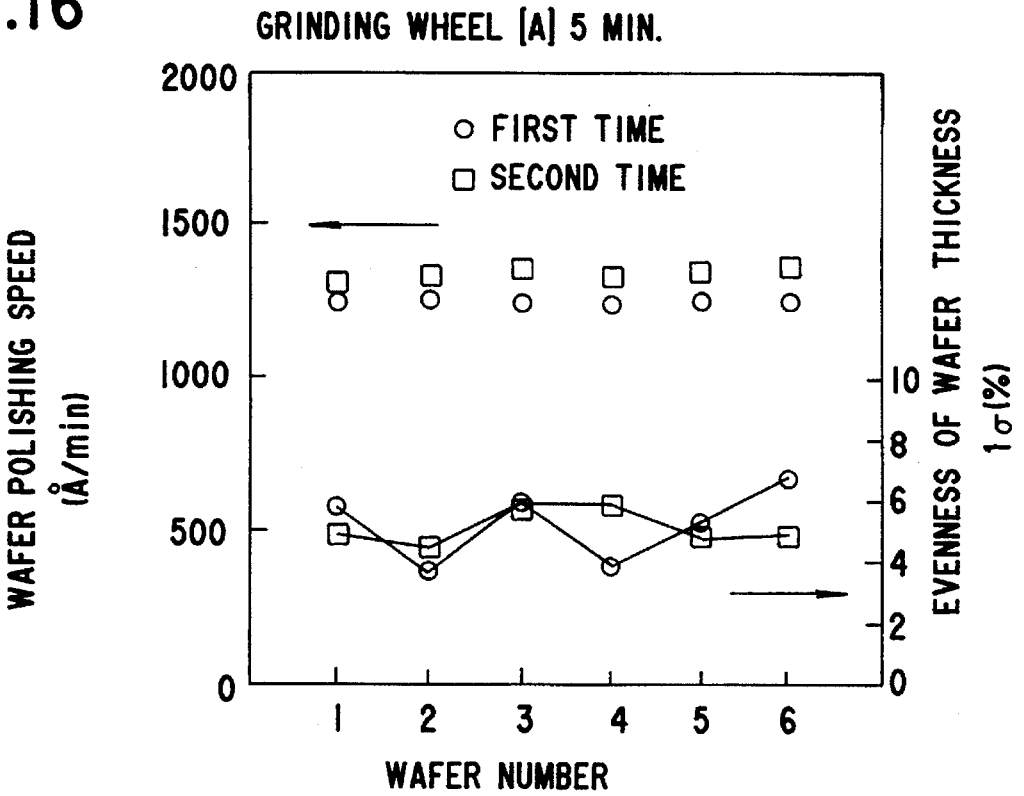
FIG. 16 is a graph when the truing time is five minutes in truing wheel (a)

The results of the experiment are shown in FIGS. 15 and 16. As is clear from FIG. 15, when the truing time was three minutes, there was no difference in the wafer polishing speed between after the first truing and the second truing. However, when the truing time was five minutes as shown in FIG. 16, as was confirmed in the above-described experiment, the wafer polishing speed after the second truing was increased more than after the first truing. This is not desirable for practical use. No significant difference in the evenness of the thickness of each wafer was seen between the case of three minutes and the case of five minutes. Therefore, in this case, three minutes proved to be desirable for the truing time.

Figure 17:
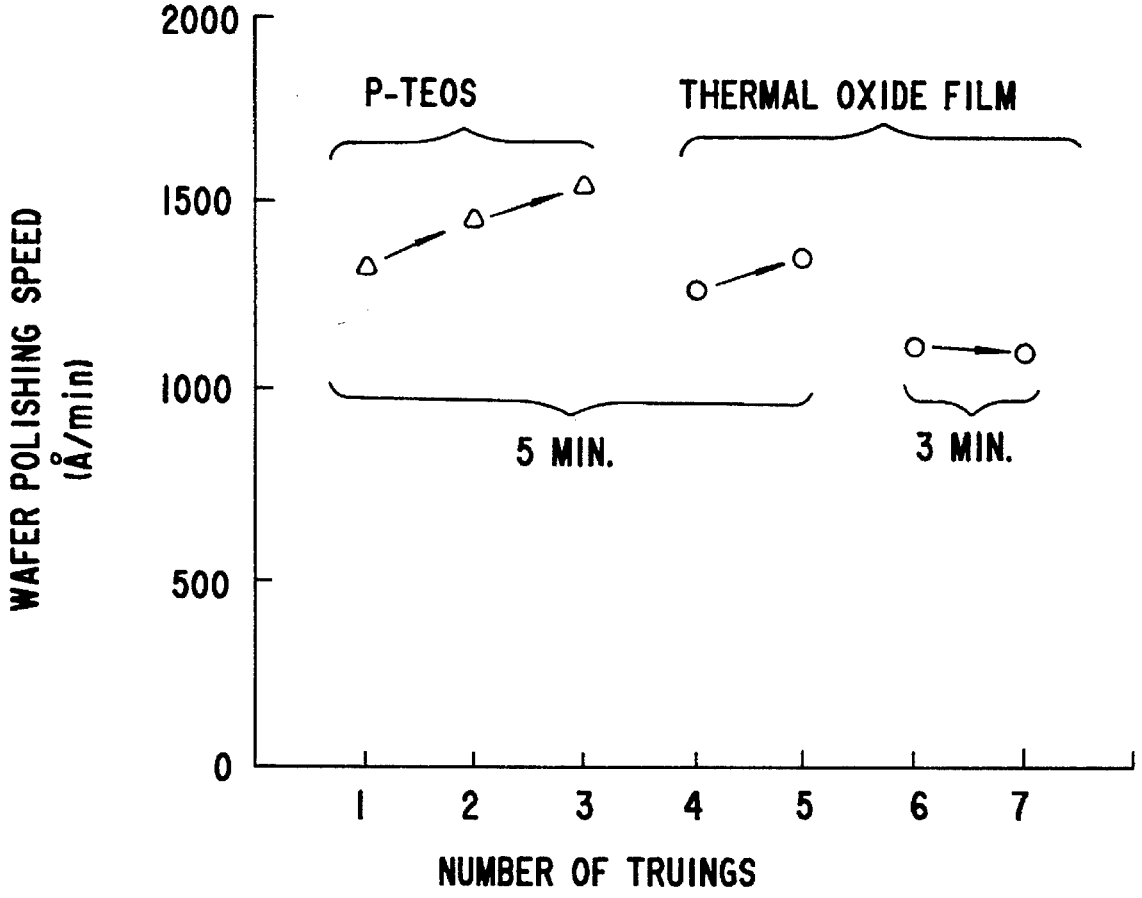
FIG. 17 is a graph in a case in which the material of the wafer polishing surface and the truing time are changed in truing wheel (a).

FIG. 17 is a graph illustrating the result when the same polishing pad was trued for three minutes or five minutes by using truing wheel (a) and the wafer polishing speed was measured. In this case, for the initial three measurements, truing was performed for five minutes for each measurement, after which a silicon wafer having a silica film (P-TEOS film) formed thereon by a plasma method was polished and polishing speed was measured. For fourth and fifth measurements, truing was performed for five minutes for each measurement, after which a silicon wafer having a silica film formed thereon by a thermal oxidation method was polished and polishing speed was measured. For sixth and seventh measurements, truing was performed for three minutes for each measurement, after which a silicon wafer having a silica film formed thereon by a thermal oxidation method was polished and polishing speed was measured. From the results in FIG. 17 also, three minutes proved to be desirable for the truing time.

As has been described, in the truing apparatus for a wafer polishing pad in accordance with the first aspect of the present invention, since a self-aligning bearing is disposed between a truing grinding wheel and a grinding wheel rotation mechanism so as to allow the titled movement of the truing grinding wheel in the truing step, even when a slight slope is present on the surface of the polishing during truing, the polishing surface of the truing grinding wheel is brought into parallel abutment with the polishing pad in such a manner as to follow the slight slope, and the abutment pressure between the polishing pad and the truing grinding wheel can always be maintained at less than a fixed value. Therefore, the polishing pad will not be ground more than necessary by excessive local pressure, making it possible to prevent the polishing pad from being consumed.

Nevertheless, an excellent flattening effect can be obtained by rubbing the polishing pad with a great number of ultra-abrasive grains projecting from the polishing surface. Since the polishing surface of the truing grinding wheel is brought into abutment over with the polishing pad the overall width of one circumferential portion of a wafer polishing area and pure water is supplied from the inside of the truing grinding wheel to between the polishing surface and the polishing pad, not only is it possible particularly to make the wafer polishing area flat, but it is also possible to supply pure water between the truing grinding wheel and the polishing pad, making it possible to quickly expel foreign matter caused by truing from the wafer polishing area.

In the truing apparatus for a wafer polishing pad in accordance with the second aspect of the present invention, since the grain size of ultra-abrasive grains is set at #60 to #230, it is possible to obtain a satisfactory flattening effect without hardly grinding the material of the polishing pad by setting the abutment pressure of the truing grinding wheel in a predetermined range. Further, since a self-aligning bearing is disposed between the truing grinding wheel and the grinding wheel rotation mechanism so as to allow the tilted movement of the truing grinding wheel, even when a slight slope is present on the surface of the polishing pad during truing, the polishing surface of the truing grinding wheel is brought into parallel abutment with the polishing pad in such a manner as to follow the slight slope, and the abutment pressure between the polishing pad and the truing grinding wheel can always be maintained at less than a fixed value. From this respect also, it is possible to prevent the wasteful consumption of the polishing pad.

What is claimed is:

1. A truing apparatus for truing a wafer polishing pad, which apparatus is attached to a wafer polishing apparatus for polishing a plurality of wafers while the wafers are rotated on a polishing pad attached to a platen and which apparatus trues the surface of said polishing pad, said truing apparatus comprising:

a truing grinding wheel having an annular abrasive grain layer including ultra-abrasive grains electrodeposited therein in a metallic plating bath;

a grinding wheel support means for rotatably supporting said truing grinding wheel in a state in which the polishing surface of said abrasive grain layer is brought into abutment with the surface of the polishing pad;

a grinding wheel rotation means for rotating said truing grinding wheel about its axis;

a self-aligning bearing means, disposed between said truing grinding wheel and said grinding wheel rotation means, for allowing the tilted movement of the truing grinding wheel; and pure water supply means for supplying pure water from the interior of said truing grinding wheel to a region between the polishing surface and the polishing pad, wherein the outer diameter of said truing polishing surface is greater than the outer diameter of a wafer to be polished by said polishing pad, and said grinding wheel support means brings the polishing surface of said truing grinding wheel into abutment with the polishing pad over the overall width of one circumferential portion of an annular wafer polishing area on the surface of said polishing pad.

2. A truing apparatus according to claim 1, wherein the grain size of said ultra-abrasive grains is set at #60 to #230.

3. A truing apparatus for a wafer polishing pad, for truing the surface of a polishing pad which is attached onto a platen of a wafer polishing apparatus and which is used for mechanical-chemical polishing of a wafer, said truing apparatus comprising:

a truing grinding wheel having an annular abrasive grain layer including ultra-abrasive grains electrodeposited therein in a metallic plating bath;

a grinding wheel support means for rotatably supporting said truing grinding wheel in a state in which the polishing surface of said abrasive grain layer is brought into abutment with the surface of the polishing pad;

a grinding wheel rotation means for rotating said truing grinding wheel about its axis;

a self-aligning bearing means, disposed between said truing grinding wheel and said grinding wheel rotation means, for allowing the tilted movement of the truing grinding wheel; and pure water supply means for supplying pure water from the interior of said truing grinding wheel to a region between the polishing surface and the polishing pad, wherein the grain size of said ultra-abrasive grains is set at #60 to #230.

4. A truing apparatus according to any one of claims 1 to 3, wherein said grinding wheel support means is arranged to bring said truing grinding wheel into abutment with said polishing pad at 0.1 to 1 $kgf/cm^2$.

5. A truing apparatus according to any one of claims 1 to 3, wherein said grinding wheel support means comprises:

a base;

a grinding wheel hoisting and lowering means for moving said truing grinding wheel up and down with respect to the base; and a grinding wheel advance/retreat means for making a truing grinding wheel move forward or backward between a position at which truing grinding wheel is retracted from the wafer polishing apparatus and a truing position.

6. A truing apparatus according to any one of claims 1 to 3, wherein the abrasive grain layer of said truing grinding wheel is formed by bonding an ultra-abrasive cloth to a grinding wheel base wherein ultra-abrasive grains are electrodeposited on a surface of said cloth.

7. A truing apparatus according to any one of claims 1 to 3, wherein said grinding wheel rotation means is connected to a control means, wherein said control means is programmed so as to operate said grinding wheel rotation mechanism in order to perform truing continuously for 0.5 to 5 minutes in one truing step.

8. A truing apparatus according to any one of claims 1 to 3, wherein a plurality of grooves are formed in said abrasive grain layer.

* * * * *